US006648994B2

(12) United States Patent
Sunakawa et al.

(10) Patent No.: US 6,648,994 B2
(45) Date of Patent: Nov. 18, 2003

(54) METHODS FOR PRODUCING IRON-BASED AMORPHOUS ALLOY RIBBON AND NANOCRYSTALLINE MATERIAL

(75) Inventors: Jun Sunakawa, Shimane-ken (JP); Yoshio Bizen, Shimane-ken (JP); Shunsuke Arakawa, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/748,872

(22) Filed: Dec. 28, 2000

(65) Prior Publication Data

US 2001/0007266 A1 Jul. 12, 2001

(30) Foreign Application Priority Data

Jan. 6, 2000 (JP) ..... 2000-000617

(51) Int. Cl.[7] ..... C22C 45/02
(52) U.S. Cl. ..... 148/561; 148/121
(58) Field of Search ..... 148/121, 561, 148/540, 541

(56) References Cited

U.S. PATENT DOCUMENTS 4,257,830 A * 3/1981 Tsuya et al. ..... 148/112
5,160,379 A * 11/1992 Yoshizawa et al. ..... 148/121
5,647,921 A * 7/1997 Odagawa et al. ..... 148/561
6,425,960 B1 * 7/2002 Yoshizawa et al. ..... 148/121

FOREIGN PATENT DOCUMENTS

| | | |
|---|---|---|
| EP | 0 056 110 A1 | 7/1982 |
| JP | 58-000358 A | 1/1983 |
| JP | 01-079342 A | 3/1989 |
| JP | 03-219009 A | 9/1991 |
| JP | 04-229604 A | 8/1992 |

* cited by examiner

*Primary Examiner*—George Wyszomierski
(74) *Attorney, Agent, or Firm*—Sughrue Mion, PLLC

(57) ABSTRACT

The present invention provides a method for producing a Fe-based amorphous alloy ribbon comprising the steps of: ejecting a molten Fe-based alloy containing 10 atomic % or less of B onto a cooling roll to solidify the molten Fe-based alloy; and peeling the solidified Fe-based alloy from the cooling roll when the solidified Fe-based alloy has a temperature of 100 to 300° C. A Fe-based amorphous alloy ribbon having no crystalline phase is stably, continuously produced without breakage by this method.

10 Claims, 2 Drawing Sheets

METHODS FOR PRODUCING IRON-BASED AMORPHOUS ALLOY RIBBON AND NANOCRYSTALLINE MATERIAL

BACKGROUND OF THE INVENTION

The present invention relates to a method for producing a Fe-based amorphous alloy ribbon, and to a method for producing a nanocrystalline material from the Fe-based amorphous alloy ribbon.

As a method for producing an amorphous alloy ribbon, molten alloy-quenching methods such as a single roll method, a twin roll method, a centrifugal quenching method, etc. have been widely known. Among the methods, preferred from the viewpoints of productivity and easy maintenance is the single roll method, wherein the amorphous alloy ribbon is obtained by ejecting a molten alloy onto a cooling roll rotating at a high speed to rapidly solidify the molten alloy.

A nanocrystalline material can be produced by subjecting the amorphous alloy ribbon obtained by such a method to a heat treatment. Typical Fe-based nanocrystalline materials have a composition such as Fe—Si—B—(Nb, Ti, Hf, Mo, W, Ta)—Cu, Fe—(Co, Ni)—Cu—Si—B—(Nb, W, Ta, Zr, Hf, Ti, Mo), Fe—(Hf, Nb, Zr)—B, Fe—Cu—(Hf, Nb, Zr)—B, etc. described in Japanese Patent Publication No. 4-4393, Japanese Patent Publication No. 7-74419, Japanese Patent No. 2812574, etc.

The nanocrystalline material has an excellent heat stability compared with the amorphous alloy, and exhibits a little change with time in properties thereof, a low magnetostriction and a high permeability, thereby being used for a common-mode choke coil, a pulse transformer, an circuit breaker, etc.

It is important for the amorphous alloy ribbons used as a precursor for the nanocrystalline materials to have no crystalline phase before the heat treatment. A crystalline phase formed in the amorphous alloy ribbon before the heat treatment, for example while casting, comprises crystal grains extremely larger than those formed in a homogeneous amorphous phase by the heat treatment. In the case where the amorphous alloy—ribbon partially comprising the extremely larger crystal grains is heat-treated to produce the nanocrystalline material, the resultant nanocrystalline material fails to have a uniform structure to show increased crystalline magnetic anisotropy, thereby being poor in soft magnetic properties. Thus, it is desirable that the molten alloy is quenched as rapidly as possible to prevent the amorphous alloy from crystallization.

However, in the case where the molten alloy is quenched too rapidly, the amorphous alloy tends to be broken in the course of producing the amorphous alloy ribbon, so that the ribbon cannot be continuously obtained. Further, although the amorphous alloy ribbon is generally wound in a toroidal core shape to use, the breakage of the alloy makes it difficult to produce the core continuously.

OBJECT AND SUMMARY OF THE INVENTION

An object of the present invention is to provide a method for stably producing a Fe-based amorphous alloy ribbon having no crystalline phase without breakage continuously, and a method for producing a nanocrystalline material excellent in soft magnetic properties from the Fe-based amorphous alloy ribbon.

As a result of intense research in view of the above object, the inventors have found that a solidified Fe-based alloy containing 10 atomic % or less of B is peeled from a cooling roll at a controlled temperature, to stably, continuously obtain a Fe-based amorphous alloy ribbon without breakage. The present invention has been accomplished by the finding.

Thus, a method for producing a Fe-based amorphous alloy ribbon according to the present invention comprises the steps of: ejecting a molten Fe-based alloy containing 10 atomic % or less of B onto a cooling roll to solidity the molten Fe-based alloy; and peeling the solidified Fe-based alloy from the cooling roll when the solidified Fe-based alloy has a temperature of 100 to 300° C. Incidentally, the term "nanocrystalline material" as used in the present invention means a material comprising crystal grains having an average grain diameter of 300 nm or less, preferably 100 nm or less.

In a method for producing a nanocrystalline material according to the present invention, the Fe-based amorphous alloy ribbon obtained by the above method is subjected to a heat treatment at a temperature equal to or more than a crystallization temperature of the Fe-based amorphous alloy ribbon, to produce the nanocrystalline material.

To make crystal grains in the nanocrystalline material fine, the molten Fe-based alloy preferably contains 15 atomic % or less of group 4A, 5A and/or 6A element. Further, the molten Fe-based alloy may contain preferably 0.5 to 15 atomic %, more preferably 1 to 10 atomic % of Nb. Furthermore, the molten Fe-based alloy preferably contains 0.1 to less than 4 atomic % of Cu, and/or 5 to 25 atomic % of Si.

It is particularly preferable that the molten Fe-based alloy has a composition comprising 2 to 10 atomic % of B, 1 to 5 atomic % of Nb, 0.1 to 3 atomic % of Cu, 10 to 20 atomic % of Si and the balance being substantially Fe. The Fe-based amorphous alloy ribbon preferably has a thickness of 8 to 25 $\mu$m.

The solidified Fe-based alloy is peeled from the cooling roll when the solidified Fe-based alloy has a temperature of preferably 100 to 250° C., more preferably 150 to 250° C.

DETAILED DESCRIPTION OF THE PREFERRED EMBODIMENTS

Figure 1:
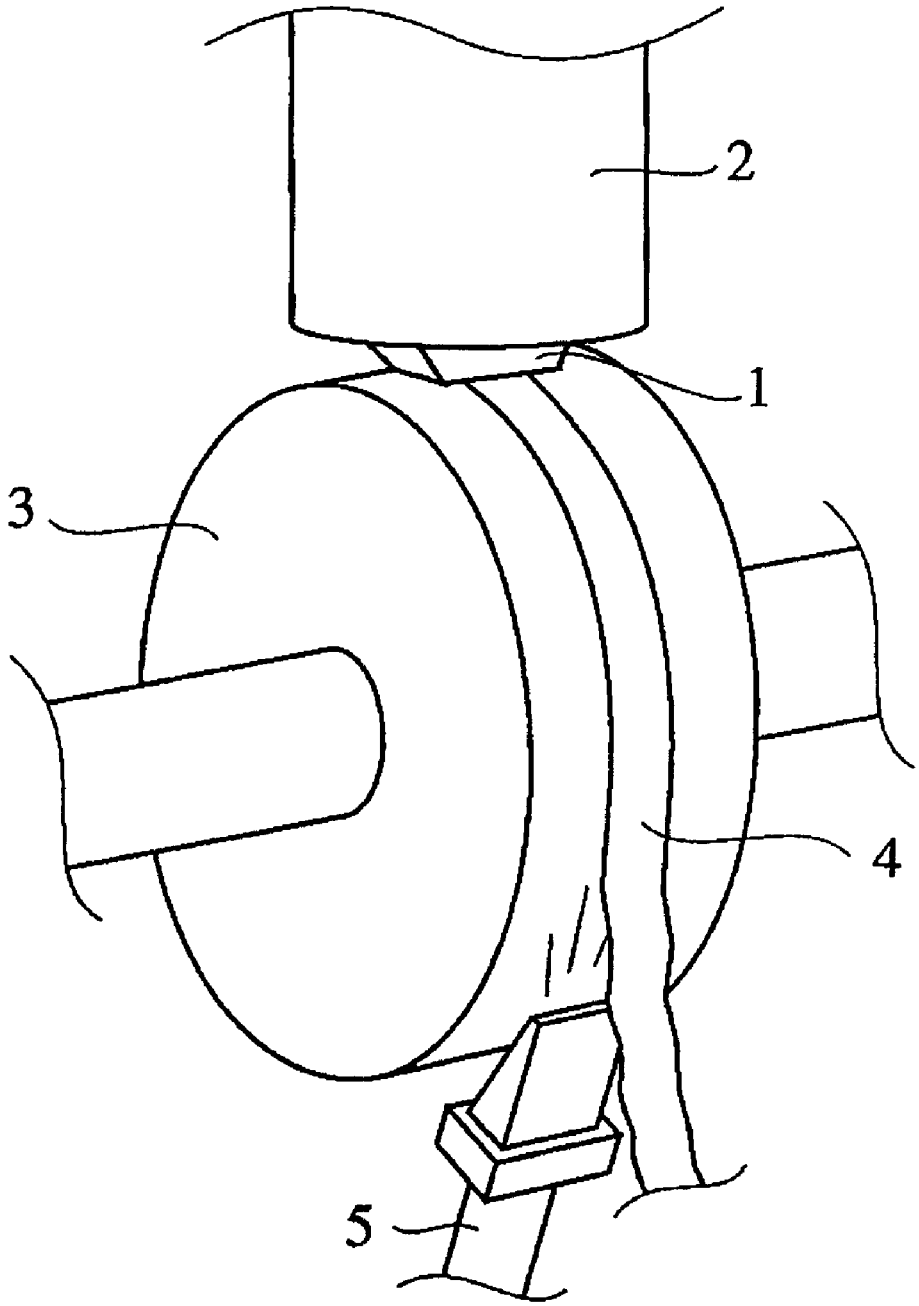
FIG. 1 is a schematic perspective view showing an embodiment of the method for producing a Fe-based amorphous alloy ribbon according to the present invention.

In a method for producing a Fe-based amorphous alloy ribbon according to the present invention, a molten Fe-based alloy is solidified by ejecting onto a cooling roll, and a temperature of the solidified Fe-based alloy is controlled at 100 to 300° C. when it is peeled from the cooling roll. The temperature is hereinafter referred to as "peeling temperature".

In a method for producing a nanocrystalline material according to the present invention, the Fe-based amorphous alloy ribbon is subjected to a heat treatment at a temperature equal to or more than a crystallization temperature thereof.

B content of the Fe-based alloy used in the present invention is 10 atomic % or less. B acts to increase an amorphous-forming ability of the Fe-based alloy, so that the alloy preferably contains 2 atomic % or more of B. However, in the case where the B content exceeds 10 atomic %, a nanocrystalline material obtained from the Fe-based amorphous alloy ribbon exhibits deteriorated magnetic properties. Specifically, in this case, a magnetically hard intermetallic compound such as $Fe_3B$, $Fe_2B$, etc., which suppresses magnetic domain wall motion, is often deposited in the alloy during the heat treatment, whereby a uniform nanocrystalline phase substantially composed of a bcc-Fe solid solution is hardly obtained.

The Fe-based alloy containing 10 atomic % or less of B is generally poor in an amorphous-forming ability. Further, formed amorphous phase has a remarkably unstable structure, where short range ordering portions are formed to reduce strength of the Fe-based alloy. Therefore, to continuously produce the Fe-based amorphous alloy ribbon having no crystalline phase without breakage, the peeling temperature is controlled at 100 to 300° C., in the present invention. The reason for the limit of the peeling temperature will be described below.

When the peeling temperature is less than 100° C., the Fe-based amorphous alloy ribbon is broken in the course of producing the ribbon. Until the ribbon is peeled from the cooling roll, the ribbon is adhered to the cooling roll and applied a shrinkage stress corresponding to its temperature change to. The amorphous Fe-based alloy containing 10 atomic % or less of B has unstable structure as described above, so that it seems to be broken by the shrinkage stress more easily than an amorphous alloy containing more than 10 atomic % of B. Such a breakage is caused specifically in the Fe-based amorphous alloy ribbon containing 10 atomic % or less of B, and this is hardly caused in the Fe-based amorphous alloy ribbon containing more than 10 atomic % of B.

When the peeling temperature is more than 300° C., the Fe-based amorphous alloy ribbon is often embrittled. If the peeling temperature is increased, the shrinkage stress is reduced to suppress the breakage of the ribbon. However, too high peeling temperature tends to make the ribbon brittle through the structural relaxation particular to the amorphous alloys. Of the amorphous alloys, the Fe-based amorphous alloys are liable to be embrittled by the structural relaxation. Especially, the Fe-based amorphous alloy containing 10 atomic % or less of B, used in the present invention, has unstable structure as described above, to be easily embrittled.

In the mass-production of the Fe-based amorphous alloy ribbon, the ribbon has a length of several thousand meters. If the ribbon is embrittled in such a mass-production, the ribbon is liable to be broken or cracked by only a slight torsion stress when the ribbon is wound on a reel, etc. or handled, whereby the ribbon cannot be produced easily and effectively. Therefore, the upper limit of the peeling temperature is 300° C. in the present invention.

The peeling temperature is preferably 100 to 250° C., more preferably 150 to 250° C.

In the present invention, the temperature of the solidified Fe-based alloy may be measured by a radiation thermometer manufactured by Keyence Corporation. The radiation thermometer may be calibrated by adhering the amorphous alloy to a plate made of the same material as the cooling roll, and by measuring the temperature change of the amorphous alloy using a thermocouple while heating the plate.

The Fe-based alloy used in the present invention preferably contains group 4A, 5A and/or 6A element that acts to make crystal grains in the nanocrystalline material fine. The preferred content of group 4A, 5A and/or 6A element is 15 atomic % or less in the Fe-based alloy. When the content is more than 15 atomic %, the Fe-based alloy comes to be brittle after casting.

Among the group 4A, 5A and 6A elements, Nb is particularly effective to make crystal grains fine, so that the Fe-based alloy used in the present invention preferably contains 0.5 to 15 atomic % of Nb. Less than 0.5 atomic % of Nb cannot sufficiently make the crystal grains fine. The content of Nb is more preferably 1 to 10 atomic %, furthermore preferably 1 to 5 atomic %.

By adding Cu to the Fe-based alloy together with Nb, the number of sites, which form a core during the heat treatment, is increased, thereby more effectively making crystal grains in the nanocrystalline material fine. The preferred content of Cu in the Fe-based alloy is 0.1 to less than 4 atomic %. When the content of Cu is less than 0.1 atomic %, sufficient effect cannot be obtained. On the other hand, when the content is 4 atomic % or more, the Fe-based amorphous alloy ribbon comes to be brittle after casting, additionally, Cu is often separated from Fe even in the case of using the molten alloy-quenching method to be not uniformly dissolved in Fe. The content is more preferably 3 atomic % or less.

It is preferable that the Fe-based alloy used in the present invention contains 5 to 25 atomic % of Si from the viewpoint of an amorphous-forming ability and magnetic properties of the nanocrystalline material. When the content of Si in the Fe-based alloy is more than 25 atomic %, the Fe-based amorphous alloy ribbon is embrittled. The content is more preferably 10 to 20 atomic %.

As mentioned above, it is particularly preferable that the Fe-based alloy used in the present invention has a composition comprising 2 to 10 atomic % of B, 1 to 5 atomic % of Nb, 0.1 to 3 atomic % of Cu, 10 to 20 atomic % of Si and the balance being substantially Fe.

Further, as described above, the Fe-based alloy containing 10 atomic % or less of B is generally poor in the amorphous-forming ability, so that the amorphous phase formed therein has a remarkably unstable structure, to be embrittled. When the Fe-based amorphous alloy ribbon according to the present invention is too thick, ribbon-cooling rate is lowered, whereby the ribbon is more remarkably embrittled. Therefore, the ribbon preferably has a thickness of 25 $\mu$m or less to obtain a sufficient ribbon-cooling rate. On the other hand, when the ribbon is too thin, the ribbon unavoidably has a pore, etc., whereby it comes to be difficult to produce a uniform ribbon. The ribbon preferably has a thickness of 8 $\mu$m or more.

According to the present invention, the nanocrystalline material is produced by subjecting the Fe-based amorphous alloy ribbon obtained by the above-mentioned method to the heat treatment at the crystallization temperature thereof or more. The heat treatment is preferably carried out at the temperature of $T_x$ to $T_x$+200° C., wherein $T_x$ represents the crystallization temperature of the Fe-based amorphous alloy ribbon.

EXAMPLE 1

A Fe-based amorphous alloy ribbon of Sample No. 1 having a composition of $Cu_1Nb_3Si_{15.5}B_7Fe_{bal.}$ (atomic %) was produced by a single roll rapidly quenching apparatus shown in FIG. 1. First, a Fe-based alloy ingot having the above composition was fed into a crucible 2 and melted by high-frequency induction. Then, the molten Fe-based alloy was ejected onto a cooling roll 3 made of a Cu—Be alloy through a nozzle 1, to rapidly cool and solidify the Fe-based alloy. The solidified Fe-based alloy was peeled from the cooling roll 3 by a high-pressure nitrogen gas jet ejected from a peeling nozzle 5 at a peeling temperature of 70° C., to obtain the Fe-based amorphous alloy ribbon 4 having a width of 27 mm and a thickness of 19 μm. Incidentally, the outer diameter of the cooling roll 3 was 600 mm, and the peripheral speed thereof was 27 m/s.

Fe-based amorphous alloy ribbons of Sample Nos. 2 to 5 were produced in the same manner as the ribbon of Sample No. 1 except that the peeling temperature was changed as shown in Table 1, respectively. The peeling temperature was controlled by changing a temperature of cooling medium flowing in the cooling roll 3.

Each of the Fe-based amorphous alloy ribbons of Sample Nos. 1 to 5 was evaluated by observing whether breakage of the ribbon was occurred in the course of its production, and whether a crack of the ribbon was formed in the 180° bending test according to JIS Z 2248. The results are shown in Table 1.

TABLE 1

| Sample No. | Peeling Temperature (° C.) | Breakage | Crack |
|---|---|---|---|
| 1 | 70 | Observed | None |
| 2 | 120 | None | None |
| 3 | 200 | None | None |
| 4 | 280 | None | None |
| 5 | 350 | None | Observed |

As shown in Table 1, the comparative ribbon of Sample No. 1, which is peeled from the cooling roll at the peeling temperature of less than 100° C., was broken when it was peeled from the cooling roll by the high-pressure nitrogen gas jet. On the other hand, although the comparative ribbon of Sample No. 5, which is peeled from the cooling roll at the temperature of more than 300° C., could be continuously produced without breakage, cracks were observed therein in the 180° bending test. In contrast with this, in the ribbons according to the present invention of Sample Nos. 2 to 4, the breakage and crack were not observed.

Figure 2:
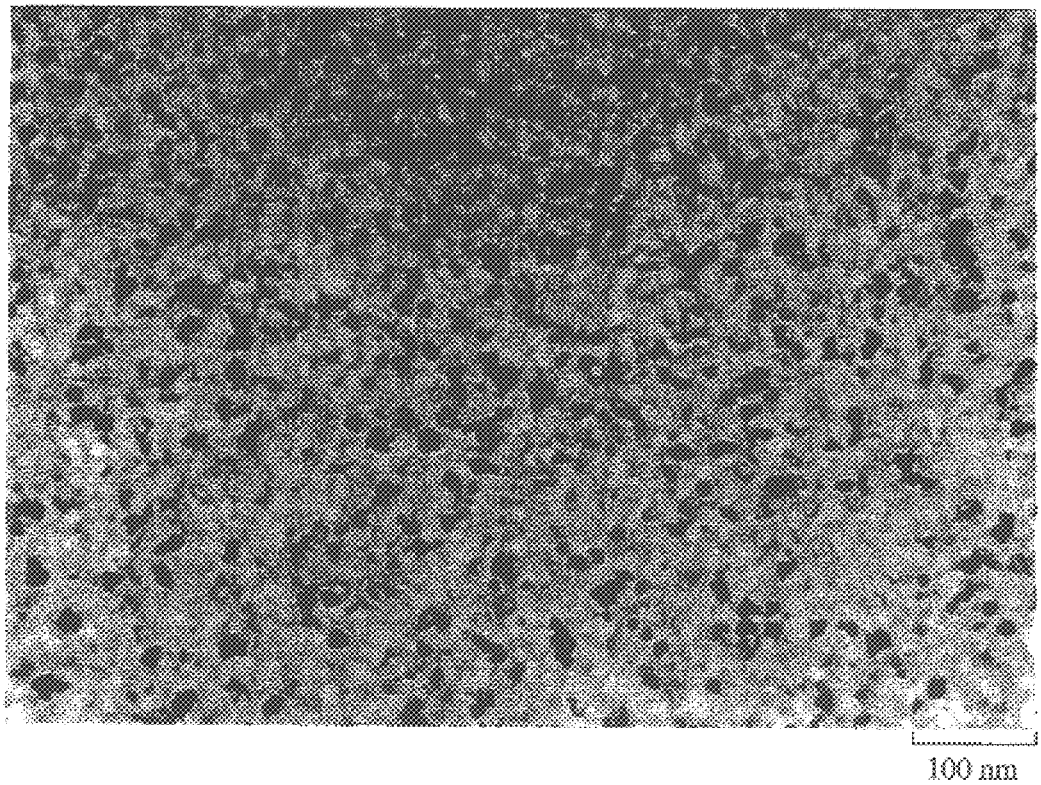
FIG. 2 is a photography showing the microstructure of the nanocrystalline material obtained by the method according to the present invention.

The ribbon of Sample No. 2 was subjected to a heat treatment at 550° C. to obtain a nanocrystalline material. The nanocrystalline material was observed with respect to its structure by a transmission electron microscope. FIG. 2 is a photography showing the microstructure of this nanocrystalline material. As is clear from FIG. 2, the nanocrystalline material has a uniform structure composed of crystal grains having an—average grain diameter of 100 nm or less.

Further, each of the ribbons of Sample Nos. 3 and 4 was heat-treated to obtain a nanocrystalline material, and observed by a transmission electron microscope in the same manner as the ribbon of Sample No. 2. As a result, each of these nanocrystalline materials had a uniform structure composed of a crystal grains having an average grain diameter of 30 nm or less.

EXAMPLE 2

A Fe-based amorphous alloy ribbon of Sample No. 6 having a composition of $Cu_1Mo_3Si_{15.5}B_8Fe_{bal.}$ (atomic %) was produced by a single roll rapidly quenching apparatus shown in FIG. 1. First, a Fe-based alloy ingot having the above composition was fed into a crucible 2 and melted by high-frequency induction. Then, the molten Fe-based alloy was ejected onto a cooling roll 3 made of a Cu—Be alloy through a nozzle 1, to rapidly cool and solidify the Fe-based alloy. The solidified Fe-based alloy was peeled from the cooling roll 3 by a high-pressure nitrogen gas jet ejected from a peeling nozzle 5 at a peeling temperature of 75° C., to obtain the Fe-based amorphous alloy ribbon 4 having a width of 27 mm and a thickness of 19 μm. Incidentally, the outer diameter of the cooling roll 3 was 800 mm, and the peripheral speed thereof was 27 m/s.

Fe-based amorphous alloy ribbons of Sample Nos. 7 to 10 were produced in the same manner as the ribbon of Sample No. 6 except that the peeling temperature was changed as shown in Table 2, respectively. Further, based amorphous alloy ribbons of Sample Nos. 11 to 15 were produced in the same manner as the ribbon of Sample No. 6 except that the composition of the Fe-based alloy was $Cu_1Mo_3Si_{15.5}B_{11}Fe_{bal.}$ (atomic %) and that the peeling temperature was changed as shown in Table 3, —respectively. The peeling temperature was controlled by changing a temperature of cooling medium flowing in the cooling roll 3.

Each of the Fe-based amorphous alloy ribbons of Sample Nos. 6 to 15 was evaluated by observing whether breakage of the ribbon was occurred in the course of its production, and whether a crack of the ribbon was formed in the 180° bending test according to JIS Z 2248. The results are shown in Tables 2 and 3.

TABLE 2

| Sample No. | Peeling Temperature (° C.) | Breakage | Crack |
|---|---|---|---|
| 6 | 75 | Observed | None |
| 7 | 130 | None | None |
| 8 | 210 | None | None |
| 9 | 270 | None | None |
| 10 | 360 | None | Observed |

TABLE 3

| Sample No. | Peeling Temperature (° C.) | Breakage | Crack |
|---|---|---|---|
| 11 | 77 | None | None |
| 12 | 132 | None | None |
| 13 | 208 | None | None |
| 14 | 275 | None | None |
| 15 | 356 | None | None |

As shown in Table 2, the comparative ribbon of Sample No. 6, which is peeled from the cooling roll at the peeling temperature of less than 100° C., was broken when it was peeled from the cooling roll by the high-pressure nitrogen gas jet. On the other hand, although the comparative ribbon of Sample No. 10, which is peeled from the cooling roll at the temperature of more than 300° C., could be continuously produced without breakage, cracks were observed therein in the 180° bending test. In contrast with this, in the ribbons according to the present invention of Sample Nos. 7 to 9, the breakage and crack were not observed. As shown in Table 3, also in the comparative ribbons of Sample Nos. 11 to 15 containing 11 atomic % of B, the breakage and crack were not observed.

Each of the ribbons of Sample Nos. 7 to 9 and 11 to 15 was subjected to a heat treatment at 550° C. to obtain a nanocrystalline material. Each nanocrystalline material was observed with respect to its structure by a transmission electron microscope. As a result, each nanocrystalline material had a uniform structure composed of a crystal grains having an average grain diameter of 30 nm or less.

Further, each of the ribbons according to Sample Nos. 7 to 9 and 11 to 15 was wound to obtain a core having an outer diameter of 19 mm and an inner diameter of 15 mm. Each core was subjected to a heat treatment at 550° C. to obtain a nanocrystalline material. The nanocrystalline materials were measured with respect to permeability corresponding to a frequency of 1 kHz, respectively. As a result, the nanocrystalline materials containing 8 atomic % of B obtained from the ribbons according to the present invention of Sample Nos. 7 to 9 showed permeability of 90000 to 100000. As compared with this, permeability of the nanocrystalline materials containing 11 atomic % of B obtained from the ribbons of Sample Nos. 11 to 15 was remarkably low, 50000 to 60000.

EXAMPLE 3

A Fe-based amorphous alloy ribbon of Sample No. 16 having a composition of $Nb_7B_9Fe_{bal.}$ (atomic %) was produced by a single roll rapidly quenching apparatus shown in FIG. 1. First, a Fe-based alloy ingot having the above composition was fed into a crucible 2 and melted by high-frequency induction. Then, the molten Fe-based alloy was ejected onto a cooling roll 3 made of a Cu—Be alloy through a nozzle 1 while sealing by Ar gas, to rapidly cool and solidify the Fe-based alloy. The solidified Fe-based alloy was peeled from the cooling roll 3 by a high-pressure nitrogen gas jet ejected from a peeling nozzle 5 at a peeling temperature of 80° C., to obtain the Fe-based amorphous alloy ribbon 4 having a width of 25 mm and a thickness of 19 $\mu$m. Incidentally, the outer diameter of the cooling roll 3 was 600 mm, and the peripheral speed thereof was 25 m/s.

Fe-based amorphous alloy ribbons of Sample Nos. 17 and 18 were produced in the same manner as the ribbon of Sample No. 16 except that the peeling temperature was changed as shown in Table 4, respectively. Further, Fe-based amorphous alloy ribbons of Sample Nos. 19 to 21 were produced in the same manner as the ribbon of Sample No. 16 except that the composition of the Fe-based alloy was $Zr_2Nb_4B_{8.5}Fe_{bal.}$ (atomic %) and that the peeling temperature was changed as shown in Table 5, respectively. The peeling temperature was controlled by changing a temperature of cooling medium flowing in the cooling roll 3.

Each of the Fe-based amorphous alloy ribbons of Sample Nos. 16 to 21 was evaluated by observing whether breakage of the ribbon was occurred in the course of its production. The results are shown in Tables 4 and 5.

TABLE 4

| Sample No. | Peeling Temperature (° C.) | Breakage |
|---|---|---|
| 16 | 80 | Observed |
| 17 | 128 | None |
| 18 | 250 | None |

TABLE 5

| Sample No. | Peeling Temperature (° C.) | Breakage |
|---|---|---|
| 19 | 75 | Observed |
| 20 | 134 | None |
| 21 | 208 | None |

As shown in Table 4 and 5, the comparative ribbons of Sample Nos. 16 and 19, which are peeled from the cooling roll at the peeling temperature of less than 100° C., were broken when it was peeled from the cooling roll by the high-pressure nitrogen gas jet. In contrast with this, in the ribbons according to the present invention of Sample Nos. 17, 18, 20 and 21, the breakage and crack were not observed.

Each of the ribbons of Sample Nos. 17, 18, 20 and 21 was subjected to a heat treatment at 550° C. to obtain a nanocrystalline material. Each nanocrystalline material was observed with respect to its structure by a transmission electron microscope. As a result, each nanocrystalline material had a uniform structure composed of a crystal grains having an average grain diameter of 50 nm or less.

EXAMPLE 4

A Fe-based amorphous alloy ribbon of Sample No. 22 having a composition of $Cu_1Nb_{2.5}Si_{13.5}B_{7.5}Fe_{75.5}$ (atomic %) was produced by a single roll rapidly quenching apparatus shown in FIG. 1. First, a Fe-based alloy ingot having the above composition was fed into a crucible 2 and melted by high-frequency induction. Then, the molten Fe-based alloy was ejected onto a cooling roll 3 made of a Cu—Be alloy through a nozzle 1, to rapidly cool and solidify the Fe-based alloy. The solidified Fe-based alloy was peeled from the cooling roll 3 by a high-pressure nitrogen gas jet ejected from a peeling nozzle 5 at a peeling temperature of 200° C., to obtain the Fe-based amorphous alloy ribbon 4 having a width of 35 mm and a thickness of 17 $\mu$m. Incidentally, the outer diameter of the cooling roll 3 was 600 mm, and the peripheral speed thereof was 27 m/s.

Fe-based amorphous alloy ribbons of Sample Nos. 23 to 26 were produced in the same manner as the ribbon of Sample No. 22 except that the composition of the Fe-based alloy was changed as shown in Table 6, respectively.

The Fe-based amorphous alloy ribbon of Sample No. 22 was produced twenty times in the same manner. Each of the resultant twenty ribbons was evaluated by observing whether breakage of the ribbon was occurred in the course of its production, and whether a crack of the ribbon was formed in the 180° bending test according to JIS Z 2248. A ratio (%) of broken ribbon(s) to the twenty ribbons, and a ratio (%) of ribbon(s) cracked by the 180° bending test to the twenty ribbons are shown in Table 6. Also, each of the Fe-based amorphous alloy ribbons of Sample Nos. 23 to 26 was similarly evaluated. The results are shown in Table 6.

TABLE 6

| Sample No. | Composition (atomic %) | Breakage | Crack |
|---|---|---|---|
| 22 | $Cu_1Nb_{2.5}Si_{13.5}B_{7.5}Fe_{75.5}$ | 0% | 0% |
| 23 | $Cu_1Nb_4Si_{13.5}B_{7.5}Fe_{74}$ | 0% | 0% |
| 24 | $Cu_1Nb_{5.7}Si_{13.5}B_{7.5}Fe_{72.3}$ | 10% | 15% |
| 25 | $Cu_{3.3}Nb_{2.5}Si_{13.5}B_{7.5}Fe_{73.2}$ | 15% | 20% |
| 26 | $Cu_{4.5}Nb_{2.5}Si_{13.5}B_{7.5}Fe_{72}$ | 100% | 100% |

As shown in Table 6, each of the Fe-based amorphous alloy ribbons of Sample Nos. 24 to 26 resulted in a lower yield of the uniform ribbon. Thus, it seems preferable that the Fe-based amorphous alloy ribbons according to the present invention contains 5 atomic % or less of Nb and 3 atomic % or less of Cu.

Further, Fe-based amorphous alloy ribbons of Sample Nos. 27 to 34 were produced in the same manner as the ribbon of Sample No. 22 except that the peeling temperature and the thickness of the ribbon was changed as shown in Table 7, respectively. Incidentally, the thickness was controlled by changing the slit breadth of the nozzle 1.

The Fe-based amorphous alloy ribbon of Sample No. 27 was produced twenty times in the same manner. Each of the resultant twenty ribbons was evaluated by observing whether breakage of the ribbon was occurred in the course of its production, and whether a crack of the ribbon was formed in the 180° bending test according to JIS Z 2248. A ratio (%) of broken ribbon(s) to the twenty ribbons, and a ratio (%) of ribbon(s) cracked by the 180° bending test to the twenty ribbons are shown in Table 7. Also, each of the Fe-based amorphous alloy ribbons of Sample Nos. 28 to 34 was similarly evaluated. The results are shown in Table 7.

TABLE 7

| Sample No. | Peeling Temperature (° C.) | Thickness (μm) | Breakage | Crack |
|---|---|---|---|---|
| 27 | 200 | 20 | 0% | 0% |
| 28 | 200 | 23 | 5% | 10% |
| 29 | 200 | 27 | 45% | 70% |
| 30 | 80 | 20 | 90% | 0% |
| 31 | 150 | 20 | 0% | 0% |
| 32 | 250 | 20 | 0% | 0% |
| 33 | 300 | 20 | 0% | 15% |
| 34 | 320 | 20 | 0% | 60% |

As shown in Table 7, among the Fe-based amorphous alloy ribbons of Sample Nos. 27 to 29 peeled from the cooling roll at 200° C., the ribbon of Sample No. 29 having a thickness of 27 μm was remarkably brittle, and liable to cause the breakage and crack. As is clear from the results according to the Fe-based amorphous alloy ribbons of Sample Nos. 30 to 34 having a thickness of 20 μm, the peeling temperature is particularly preferably 150 to 250° C.

Each of the ribbons of Sample Nos. 31 and 32 was subjected to a heat treatment at 550° C. to obtain a nanocrystalline material. Each nanocrystalline material was observed with respect to its structure by a transmission electron microscope. As a result, each nanocrystalline material had a uniform structure composed of a crystal grains having an average grain diameter of 30 nm or less.

As described in detail above, a Fe-based amorphous alloy ribbon containing 10 atomic % or less of B is stably produced without breakage thereof by the method of the present invention. The Fe-based amorphous alloy ribbon is not embrittled in the course of production, to be continuously produced.

What is claimed is:

1. A method for producing a Fe-based amorphous alloy ribbon having a thickness of 20 μm or less, comprising the steps of: ejecting a molten Fe-based alloy containing 10 atomic % or less of B onto a cooling roll to solidify said molten Fe-based alloy; and peeling the solidified Fe-based alloy from said cooling roll when said solidified Fe-based alloy has a temperature of 150 to 280° C.

2. The method for producing a Fe-based amorphous alloy ribbon according to claim 1, wherein said molten Fe-based alloy contains 15 atomic % or less of group 4A, 5A and/or 6A element.

3. The method for producing a Fe-based amorphous alloy ribbon according to claim 1, wherein said molten Fe-based alloy contains 0.5 to 15 atomic % of Nb.

4. The method for producing a Fe-based amorphous alloy ribbon according to claim 3, wherein said molten Fe-based alloy contains 1 to 10 atomic % of Nb.

5. The method for producing a Fe-based amorphous alloy ribbon according to claim 1, wherein said molten Fe-based alloy contains 0.1 to less than 4 atomic % of Cu.

6. The method for producing a Fe-based amorphous alloy ribbon according to claim 1, wherein said molten Fe-based alloy contains 5 to 25 atomic % of Si.

7. The method for producing a Fe-based amorphous alloy ribbon according to claim 1, wherein said molten Fe-based alloy has a composition comprising 2 to 10 atomic % of B, 1 to 5 atomic % of Nb, 0.1 to 3 atomic % of Cu, 10 to 20 atomic % of Si and the balance being substantially Fe, and said Fe-based amorphous alloy ribbon has a thickness of 8 to 20 μm.

8. The method for producing a Fe-based amorphous alloy ribbon according to claim 1, wherein said solidified Fe-based alloy is peeled from said cooling roll when said solidified Fe-based alloy has a temperature of 150 to 250° C.

9. A method for producing a nanocrystalline material, wherein said Fe-based amorphous alloy ribbon produced by the method according to claim 1 is subjected to a heat treatment at a temperature equal to or more than a crystallization temperature of said Fe-based amorphous alloy ribbon.

10. The method for producing a Fe-based amorphous alloy ribbon according to claim 1, wherein said molten Fe-based alloy contains 2 to 10 atomic % of B.

* * * * *